United States Patent [19]

Bowden, Jr., Wade R. et al.

[11] Patent Number: 4,854,885

[45] Date of Patent: Aug. 8, 1989

[54] ELECTRICAL OUTLET RECEPTACLE WITH NON-METALLIC MOUNTING STRAP AND AUTOMATIC GROUNDING

[75] Inventors: Bowden, Jr., Wade R., Northport; David Herzfeld, Huntington, both of N.Y.

[73] Assignee: Slater Electric Inc., Glen Cove, N.Y.

[21] Appl. No.: 10,373

[22] Filed: Feb. 3, 1987

[51] Int. Cl.[4] ..... H01R 4/66

[52] U.S. Cl. ..... 439/107; 29/592.1

[58] Field of Search ..... 439/92, 94, 95, 97, 439/107, 536, 682, 685, 686, 687, 69, 402; 29/592.1, 622

[56] References Cited

U.S. PATENT DOCUMENTS

| | | | |
|---|---|---|---|
| 3,835,438 | 9/1974 | Longworth | 439/97 |
| 4,039,235 | 8/1977 | Thibeault | 439/97 |
| 4,203,638 | 5/1980 | Tansi | 439/97 |
| 4,271,337 | 6/1981 | Barkas | 439/107 X |
| 4,379,605 | 4/1983 | Hoffman | 439/402 X |

*Primary Examiner*—Eugene F. Desmond
*Attorney, Agent, or Firm*—Morgan & Finnegan

[57] ABSTRACT

An electrical outlet receptacle device adapted to be mounted adjacent a wall member having a hole therein which permits the device to be secured to an electrical outlet box mounted behind the wall member. The receptacle includes a cover formed integrally with a pair of mounting strap elements projecting from opposite ends thereof. Each mounting strap terminates in free end edges which are beveled along their front facing surfaces and elongated to the maximum possible length to fit under a wallplate intended for use with the device, and is generally squared along its side edges for maximizing the available surface area for abutting the wall member and substantially reducing the chance of having a "floating" installation. The receptacle further includes a unitary grounding element within the receptacle housing and formed with two pairs of electrical grounding contacts adjacent each group prong opening in the receptacle cover for receving a ground prong of a plug, and a pair of spring-like finger members positioned and proportioned to extend through the mounting screw aperture on one of the mounting straps to receive and grasp a mounting screw to form a continuous electrically conductive ground path from a grounded outlet box, through the mounting screw, then through the grounding element to each pair of electrical grounding contacts. Advantageously, an additional ground member is provided which includes a ground terminal screw accessible from the exterior of the receptacle housing for permitting direct termination of a ground conductor of an electrical power cable.

28 Claims, 4 Drawing Sheets

ELECTRICAL OUTLET RECEPTACLE WITH NON-METALLIC MOUNTING STRAP AND AUTOMATIC GROUNDING

BACKGROUND AND OBJECTS OF THE INVENTION

The present invention relates generally to electrical wiring devices, and, more particularly, to electrical outlet receptacle devices of improved construction, having an automatic grounding system for grounding the device to a grounded electrical outlet box without requiring a metallic mounting strap and improved mounting means for ensuring proper mounting of the device adjacent an opening formed in a wall member.

Electrical outlet receptacles for residential, hospital and industrial use are well known in the art. Hospital and industrial grades of receptacles are often made in specialized configurations or with heavy duty features in order to satisfy various code requirements (e.g., Underwriters' Laboratories Hospital Grade Test Program). Residential grade receptacles, on the other hand, are generally required to satisfy somewhat less stringent U.L. requirements and have been manufactured for years with little or no design changes so as to sell at the lowest possible cost. For example, residential grade outlet receptacles are often made with a body and cover member made from a thermo-set material using the same type of compression molds which have been in use for decades. These devices also incorporate steel mounting straps which require separate copper alloy ground contacts for mating with the ground prong of a plug inserted into the device.

Although known prior receptacle devices have provided generally satisfactory results over the years, they do suffer several disadvantages. For example the typically used thermo-set materials are relatively brittle and are susceptible to cracking or breakage during fabrication or installation. In addition, the metal mounting strap (which is either sandwiched between the receptacle body and cover or wrapped around the device) is also a source for additional fabrication, assembly and handling problems. For example, the mounting straps are typically made of steel which is susceptible to corrosion. In addition, the strap is easily deformed during fabrication and handling. Moreover, steel straps cannot directly form the ground contacts for a receptacle. Rather, separate grounding contacts made of the proper copper alloy material must be electrically connected to the mounting strap, either by riveting or pressure fitting. This necessarily involves additional parts and additional fabrication steps which contribute to the overall fabrication costs of the devices. The steel strap also requires a secondary tapping operation for accommodating the wall plate mounting screw.

The assembly method of these devices is a further source of problems. The body and cover, with the mounting strap held between them, are usually secured together by a fastening rivet or screw-like fastener which is inserted through the back of the receptacle body, through a clearance hole formed in the mounting strap and then force fit in a hole formed in the receptacle cover. To insure adequate holding power, close tolerances are required between the outer diameter of the rivet or screw-like fastener and the holes in the receptacle body and cover. Thus, if blisters are formed in the vicinity of these holes during molding or if the parts are warped in that vicinity, the resultant parts are susceptible to cracking when the fastner is installed. Further, since the only means of securing the parts together is the rivet or screw fastener, the attachment of the cover and body is vulnerable to loosening, resulting in a dangerous intermittant condition in, or total disconnection of, the electrical connections within the device.

A significant breakage problem has also been experienced in the course of installing receptacles. One common construction practice involves "dealing out" individual receptacles at each specific location where a receptacle is to be installed by actually dropping them onto the floor. Because of the brittle nature of the thermo-set materials used in the devices, the receptacles are susceptible to cracking or breakage (with the attendant loosening or disconnection of electrical connections) when they are handled in such fashion. Also, breakage can occur in normal usage after installation when, e.g., a user pulls on the electrical cable to remove the plug at some distance from the receptacle itself. Although thermo-plastic materials could be used to form the receptacle body and cover and reduce some of the breakage problems, they tend to be relatively expensive and, in any event, the mere substitution of materials would not eliminate the other drawbacks described herein.

Another disadvantage of conventional electrical outlet receptacles is the problem encountered when the wall opening cut to receive the receptacle is too large for one or both ends of the mounting strap to bear against the wall surface when the device is mounted to an electrical outlet box behind the wall. To compensate, electricians often rely on the wall plate mounting screw to hold the receptacle in place. Such installation results in what is called a "floating" installation, wherein the device mounting screws are not tightened all the way so the device can "float" relative to the outlet box. The only means for bracing the outlet receptacle against the inward force of insertion of a plug is the single wall plate mounting screw. (In a proper installation, of course, both ends of the mounting strap should abut the wall to brace the receptacle against the inward force of plug insertion.)

Such "floating" installations are undesirable because they require extra installation time. The electrician must judge how far to tighten down the mounting screws to accommodate the wallplate, yet allow enough slack to pull the device back against the wallplate. In addition, where non-metallic wall plates are used (particularly those commonly made of phenolic or urea), the wallplate can be cracked or broken by repeated insertion of plugs in a "floating" receptacle installation, since the force of insertion of the plug is sustained only by the wallplate screw.

It is therefore an object of the present invention to provide a new and improved electrical outlet receptacle which overcomes the foregoing drawbacks and is of rugged construction and capable of economical fabrication, particularly for residential grades. It is another object of the invention to provide a new and improved electrical outlet receptacle which can be fabricated essentially completely from thermo-plastic (including mounting strap portions) except for the electrical contacts/terminals and ground elements.

It is also an object of the invention to provide a new and improved electrical outlet receptacle having mounting means adapted to substantially reduce the possibility of "floating" installations. In addition, it is an object of the invention to enable incorporation of such mounting feature in outlet receptacles for various sized wallplates.

It is also an object of the present invention to provide a new and improved electrical outlet receptacle having a grounding system capable of automatically grounding the receptacle when it is mounted to a grounded metal electrical outlet box without requiring a metallic mounting strap and/or separate internal ground contacts to mate with the ground prong of a plug. It is a further object of the invention to provide such a receptacle device which also incorporates alternate grounding means for direct termination to the ground conductor of an electrical power cable.

It is yet another object of the present invention to provide an electrical outlet receptacle having a cover member and body which can be formed by simple two-part injection molding techniques. It is still another object of the invention to provide such a receptacle having a mounting strap formed integrally with the cover member to simplify fabrication and reduce the number of component parts for the complete device.

Further, it is an object of the present invention to provide a new and improved electrical outlet receptacle capable of fully automated assembly by the use of component parts which can be secured in place before the final assembly step. It is another object of the invention to provide such a receptacle device and method of assembly which obviates the need for using the usual rivet or screw-type fastener yet forms a securely assembled receptacle device.

Objects and advantages of the invention are set forth in part herein and in part will be apparent herefrom, or may be learned by practice with the invention, the same being realized and attained by means of the structures, instrumentalities and combinations pointed out in the appended claims. Accordingly, the invention resides in the novel parts, structures, arrangements, combinations, and improvements herein shown and described.

SUMMARY OF INVENTION

Briefly described, the electrical outlet receptacle device according to the present invention includes a receptacle housing which comprises a body member having electrical terminal/contact members retained therein and a cover member attached to the body member and providing plug blade access means to the electrical contacts within the receptacle device. According to one aspect of the invention, the cover member includes a pair of mounting strap elements formed integrally therewith and projecting from opposite ends of the cover member. In addition, the resultant integral mounting strap is elongated to the maximum length which will fit under a wallplate intended for use with the receptacle device. Advantageously and as preferably embodied, the extreme end edges of the mounting strap elements are beveled to maximize the elongation of the mounting strap while still enabling the receptacle to fit completely under the lip of the wallplate. Also advantageously, the mounting strap elements are generally squared-off to further increase the available surface area for abutting the wall surface adjacent the hole in which the receptacle is received when mounted to an electrical outlet box behind that wall.

According to another specific aspect of the invention, grounding means are provided for automatically grounding the receptacle when mounted to a grounded electrical outlet box without requiring the usual steel mounting strap. As preferably embodied, the grounding means comprises a unitary grounding element made in the form of a relatively elongate strip of electrically conductive material, preferably a copper alloy. The grounding element includes two segments formed into a pair of grounding contacts positioned adjacent each access aperture for the ground prong of a plug. The grounding element also includes a pair of spring fingers formed integrally therewith at one end. The spring fingers are adapted to extend through one of the apertures formed in the mounting strap elements for receiving the device mounting screws. When the mounting screw is inserted between the spring fingers and threaded into the mounting lug of the grounded electrical outlet box, a continuous electrically conductive path is provided from the grounded outlet box through the mounting screw, thence through the pair of spring fingers, along the grounding element to each pair of ground contacts within the receptacle device. Also advantageously, the device is adapted to permit direct termination of a ground conductor to the device by an additional ground member press fit into electrical contact with the grounding element and having a ground terminal screw for direct termination to the ground conductor.

It will be readily appreciated by those skilled in the art that the invention as disclosed and claimed herein achieves the objects and advantages specifically recited herein. For example, by forming the cover member with integral mounting strap elements, the overall fabrication costs and handling of parts will be substantially reduced. In addition, by elongating the integrally formed mounting strap elements in accordance with the present disclosure, the possibility of having a "floating" installation of the device is greatly reduced.

By providing the unitary grounding element having two sets of electrical ground contacts and a pair of spring fingers extending through one of the mounting screw apertures for the device, it will be found that the receptacle according to the invention can be automatically grounded to a pre-grounded electrical outlet box without requiring the usual steel mounting strap. In addition, the unitary grounding element according to the invention reduces the total number and size of parts required for assembly of the device, thereby eliminating the costs associated with the fabrication and handling of such additional parts. The grounding element according to the invention is substantially shorter, thinner and lighter than the conventional steel mounting strap and it is much easier to form and to handle during assembly, and, it eliminates the need for providing separate copper alloy ground contacts for the device.

Also, by providing the additional ground member which is in electrical communication with the grounding element according to the invention, the device is also capable of being directly terminated to the ground conducter of an electrical power cable. In addition, the press fit contact between the additional ground member and the grounding element, as disclosed more specifically hereinafter, obviates the need for riveting or welding of the ground terminal members within the device.

It should be understood that the foregoing general description and the following detailed description are exemplary and explanatory of the invention, but are not intended to be restrictive thereof or to be exhaustive of the advantages which can be achieved by the invention.

The accompanying drawings, referred to herein, and constituting a part hereof, illustrate a preferred embodiment of the invention, and, when taken together with the following detailed description, serve to illustrate the principles and advantages of the invention.

DETAILED DESCRIPTION OF PREFERRED EMBODIMENT

Figure 1:
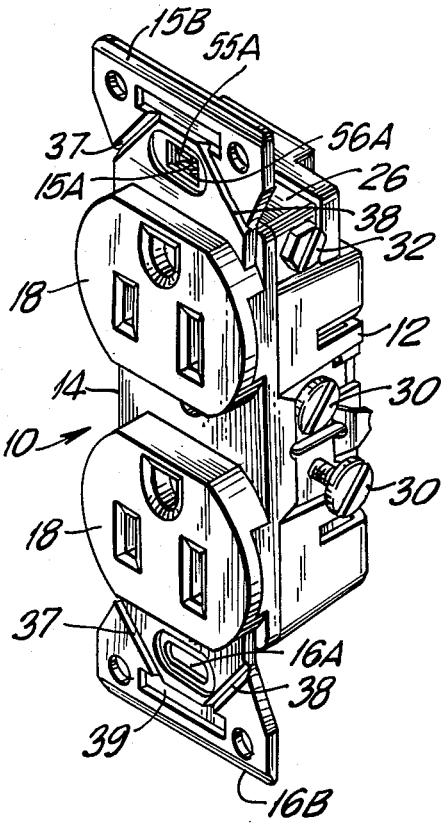
FIG. 1 is a perspective view, from the front side, of a preferred embodiment of an electrical outlet receptacle device according to the present invention.

Referring now to the embodiment of the invention illustrated in the accompanying drawings, wherein like reference characters refer to like parts throughout the various views, there is shown in FIGS. 1–11 a preferred embodiment of an electrical outlet receptacle, and its component parts, which incorporates the various features according to the present invention.

Referring more particularly to FIGS. 1–4, there are shown various views of the electrical outlet receptacle of the present invention (indicated generally by reference numeral 10), which generally includes, when fully assembled, a housing made up of body member 12 and cover member 14 which carries mounting strap elements 15 and 16 for mounting the receptacle to an electrical outlet box (not shown) which is supported behind an opening in a wall member. Cover member 14 is provided with two plug receiving face portions (each indicated at 18), each of which has a pair of apertures 19 and 20 for receiving the blades of a plug (not shown) and a third aperture 21 for receiving the ground prong of the plug. Cover member 14 also includes an aperture 41 for receiving a wall plate mounting screw (not shown) as will be described more fully below.

For ease of fabrication and durability of parts, cover member 14 and body 12 are preferably constructed of an injection moldable thermo-plastic material and mounting strap elements 15 and 16 are formed integrally with the cover member 14 in a unitary structure. Any injection moldable thermo-plastic material acceptable for use in electrical wiring devices can be used, provided it satisfies the necessary flame, impact and other electrical and mechanical property tests required by Underwriters, Laboratories or any other applicable code. Examples of such acceptable materials include polyvinyl chloride, polycarbonates, nylon, etc., and/or blends of such materials which are formulated for good impact strength, good molding characteristics and low cost, particularly the polyvinyl chloride based composition formulated by Georgia Gulf Corp. for Slater Electric Inc. and designated "TECHNALLOY" by Slater Electric.

As here embodied, body member 12 is constructed so as to receive and retain a pair of electrical contact/terminal assemblies (each indicated generally at 22) which are of generally conventional configuration and need not be described in great detail. In general, each contact/terminal assembly comprises a unitary structure which includes two pairs of contact members (24, 25) adapted to grasp the blades of a plug and a pair of terminal portions (each indicated at 23) which are connected together by a bridging portion (each indicated at 23A). The terminal members include threaded holes for receiving termination screws (each indicated at 30) which are thus accessible from the exterior of the body.

As here embodied, body 12 is made up of a bottom wall with a pair of oppositely disposed sidewalls and a pair of oppositely disposed endwalls upstanding from the bottom wall. The body includes several upstanding interior walls to define, e.g., the slots or compartments for receiving the electrical contact/terminal assemblies 22 as well as several guidance pins (e.g., indicated at 17) to help align the cover and body during the final assembly step. However, since many of these internal body structures are of generally conventional configuration, they need not be described in great detail. Only those structures which will facilitate an understanding of the various features of the present invention will be mentioned in detail hereinafter.

Figure 4:
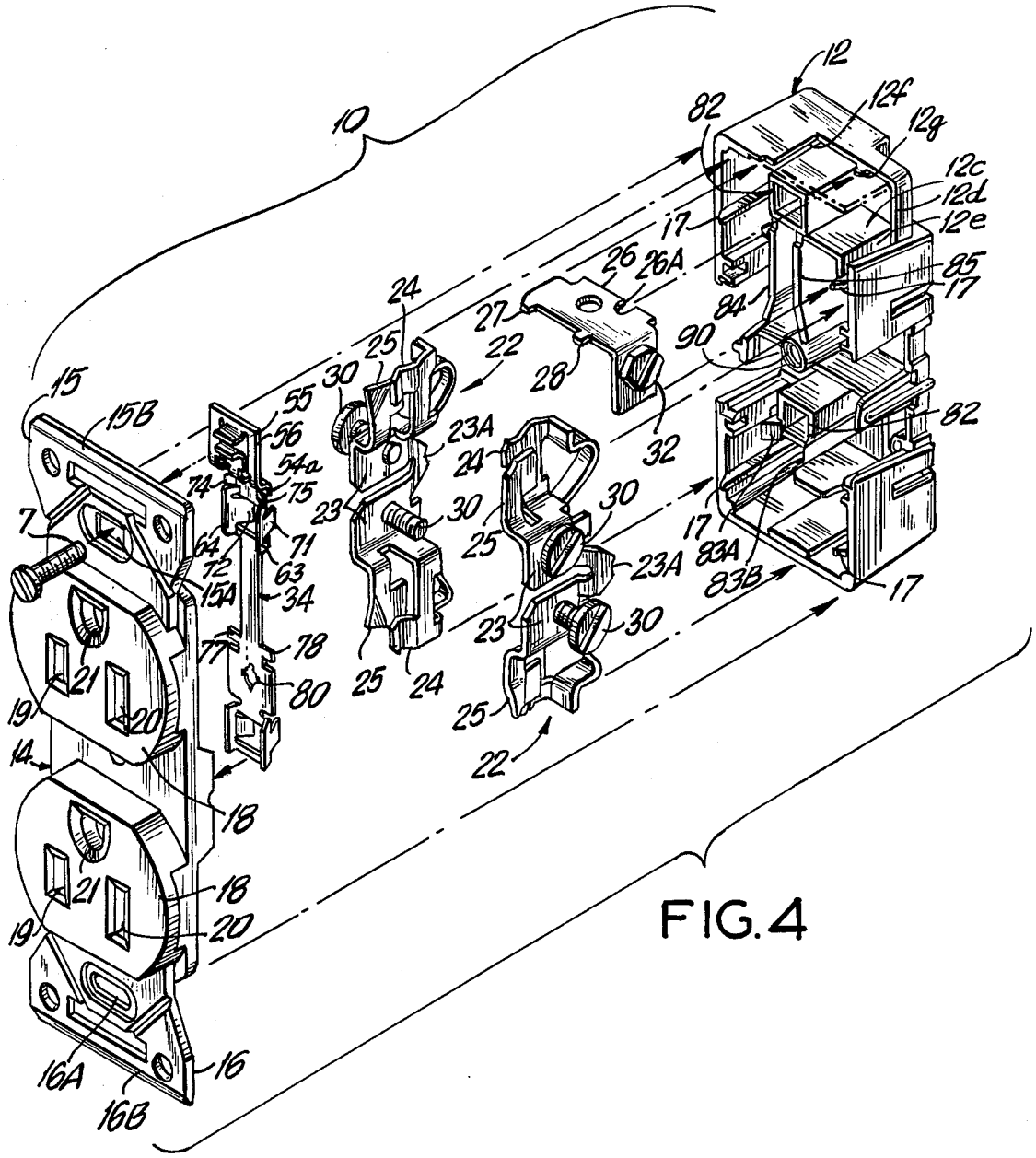
FIG. 4 is an exploded perspective view, from the same angle as FIG. 1, of the electrical outlet receptacle device shown in FIG. 1.
Figure 5:
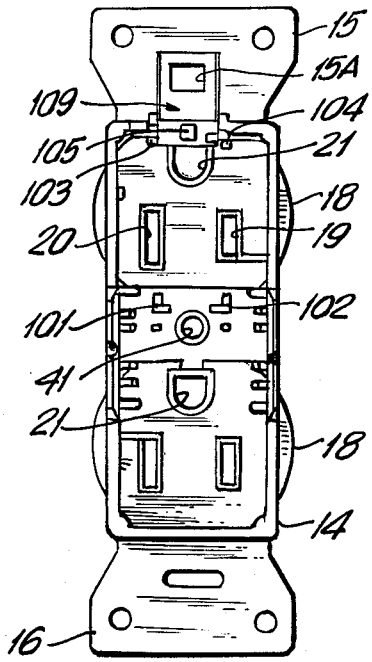
FIG. 5 is a plan view of the back side of the cover member of the electrical receptacle of the present invention.
Figure 7:
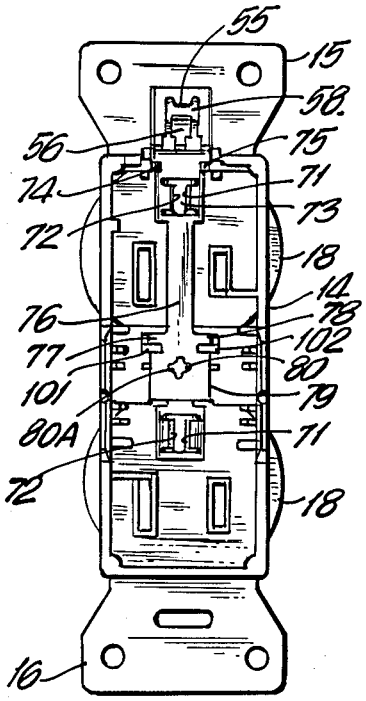
FIG. 7 is a plan view of the cover member, similar to that of FIG. 5, showing how the grounding element of FIG. 8 is pre-loaded onto the cover member in preparation for assembly of the receptacle in accordance with the invention.
Figure 8:
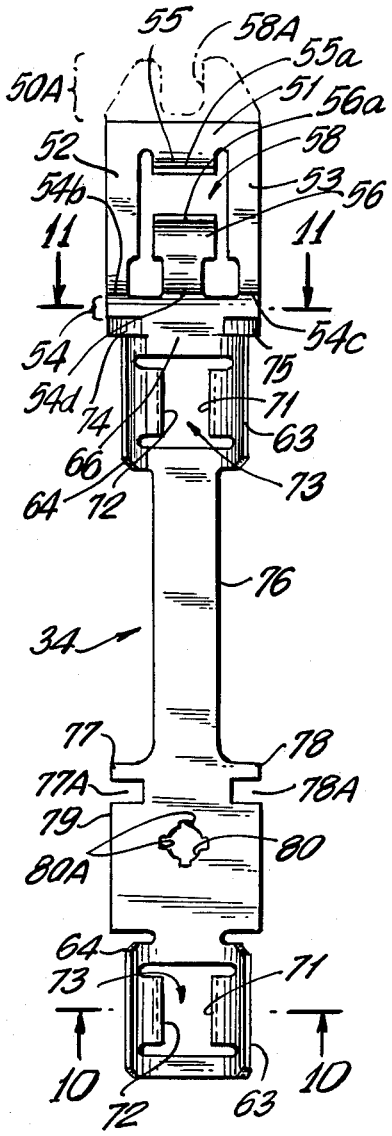
FIG. 8 is a top plan view of the grounding element according to the present invention.
Figure 9:
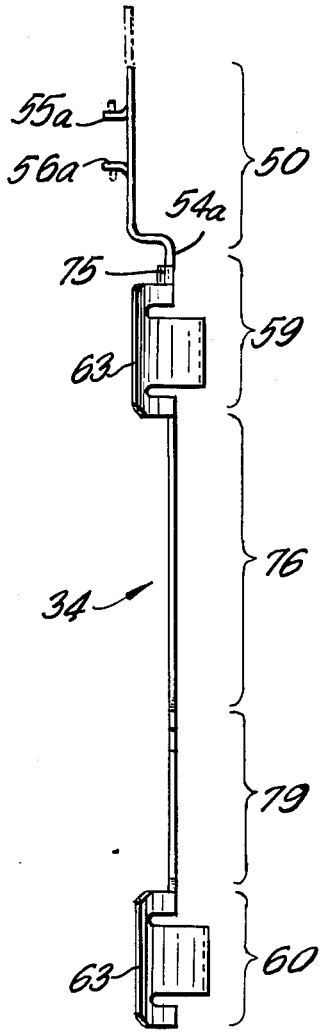
FIG. 9 is a side view of the grounding element shown in FIG. 8.
Figure 10:
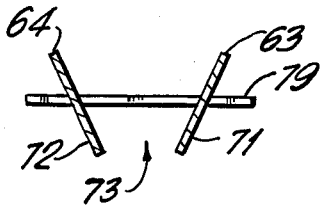
FIG. 10 is a sectional view taken along line 10—10 of the grounding element shown in FIG. 8.
Figure 11:
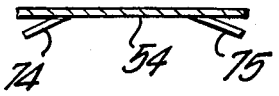
FIG. 11 is a sectional view taken along line 11—11 of the grounding element shown in FIG. 8.

Referring particularly to FIGS. 4, 5 and 7, the preferred integral formation of cover member 14 and mounting strap elements 15 and 16 will be more apparent. As indicated above, in accordance with the invention and in order to reduce the number of parts and manufacturing costs, the receptacle mounting strap is molded integrally with cover member 14 in the form of mounting strap elements 15, 16 extending from opposite ends of the device cover. Each mounting strap element includes an aperture (15A, 16A) proportioned to receive the device mounting screw. As will be described below, at least one of the apertures is adapted to achieve automatic grounding of the receptacle to a grounded electrical outlet box in accordance with the invention.

Advantageously and as preferably embodied, the mounting strap elements are formed such that the overall length of the device, as measured from their extreme opposite ends, is increased relative to the overall length of conventional steel mounting straps. Preferably, the mounting strap elements extend to the maximum possible length that can be accommodated under the wallplate to be used with the device. According to the invention, in order to facilitate maximum elongation of mounting strap portions 15 and 16, they are each advantageously provided with continuous beveled front end edges, 15B and 16B, respectively, to fit under the end edges, or rim, of the wallplate (shown in phantom in FIG. 3). For example, for standard size wallplates, the overall length of strap elements 15 and 16 may be approximately 0.1 to 0.125 inches longer than conventional steel straps, for a total overall length of about 4 3/16 to about 4¼ inches.

Figure 2:
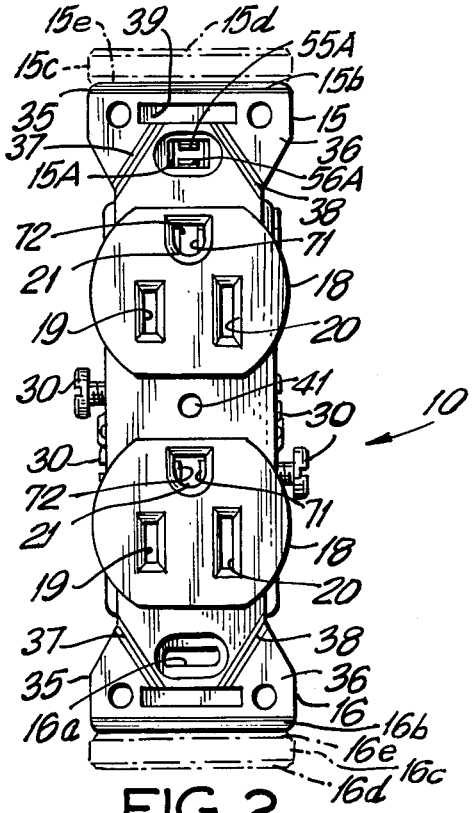
FIG. 2 is a front elevation view of the electrical outlet receptacle of FIG. 1.
Figure 3:
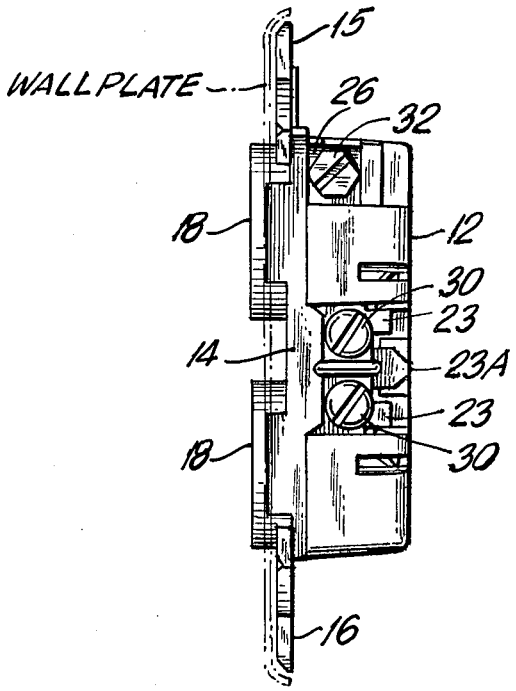
FIG. 3 is a side elevation view of the right side of the electrical outlet receptacle as shown in FIG. 1.

It will be understood by those skilled in the art that the integral mounting strap portions of the present invention can be elongated even further for installations in which larger wallplates are to be used. For example, the strap can be approximately ⅜ inch longer (i.e., about 4 9/16 to 4⅝ inches) for use with wallplates sold under the "SEMI JUMBO" designation by Slater Electric Inc., Glen Cove, New York. FIG. 2 illustrates an embodiment of such further elongation as further mounting strap elements 15*c* and 16*c* which project from the end edges of mounting strap elements 15 and 16, respectively. Further strap elements 15*c* and 16*c* are preferably beveled at their end edges (as indicated at 15*d* and 16*d*, respectively) to fit under a wallplate substantially as described above in connection with beveled edges 15*b* and 16*b*. In addition, further elements 15*c* and 16*c* can be defined by notches 15*e* and 16*e*, respectively (similar to notches 37 and 38 which are descried below), to form them as break-off tabs like tab 35 and 36 described below.

It will be appreciated by those skilled in the art that by maximizing the length of the strap elements, the maximum surface area is provided for ensuring that the strap will abut some surface of a wall member when mounted to an outlet box. This arrangement will greatly reduce the possibility of a "floating" installation.

Also advantageously, strap elements 15 and 16 extend at least as wide as (and preferably wider than) the width of the cover portion and they preferably include squared-off side portions instead of the typical round "ears" found on conventional steel mounting straps. The widened and squared-off side portions of the mounting strap elements are advantageous in that they further increase the total surface area available to abut some portion of the wall member in which the mounting hole is formed.

For use with special configuration outlet boxes where the elongated mounting strap may be longer than desired for the particular installation (e.g. for so-called "old work" boxes or mobile home boxes), strap elements 15 and 16 include break-off sections 35 and 36 (FIG. 2) which can be snapped off along diagonally extending notches 37 and 38 and recessed portion 39, thus reducing the overall length of the mounting strap.

Referring now to FIGS. 4 and 8–11, there are shown the component parts of a preferred embodiment of the improved grounding system according to the invention. As here embodied, a relatively elongate grounding element (34) is provided in the form of a bus bar type conductor which is located within the receptacle housing. Grounding element 34 is a unitary member which may be stamped in side-by-side arrangement from a relatively thin, continuous metal strip made of copper alloy, to provide automatic grounding in a single unitary part. As here embodied, element 34 includes mounting head portion 50, stem portion 76, broadened stem portion 79, and a pair of ground contact portions 59 and 60 all formed in a unitary part. Head portion 50 is provided with a generally H-shaped aperture (indicated generally at 58) to form a pair of spring-like fingers (55, 56) which are adapted to grasp a device mounting screw to provide the automatic grounding according to the invention, as will be described in greater detail hereinafter.

The resultant H-shaped aperture is thus surrounded by top edge 51, side edges 52 and 53 and connecting segment 54, leaving the cantilever-like fingers 55 and 56 extending towards each other from top edge 51 and connecting segment 54, respectively. As is evident from FIG. 9, connecting segment 54 has a double bend, or a somewhat S-shape, for locating contact head 50 in proper position adjacent the mounting screw hole 15A. In addition, the H-shaped aperture 58 preferably extends through at least the uppermost bend of connecting segment 54 and down to the second bend to provide increased flexibility and spring action for fingers 55 and 56. Connecting segment 54 will thus consist of a solid sub-segment 54*a* with three separate upstanding connecting sub-segments 54*b*, 54*c* and 54*d*. Sub-segments 54*b* and 54*c* connect side edges 52 and 53, respectively, to sub-segment 54*a*, while sub-segment 54*d* connects finger 56 to sub-segment 54*a*. As preferably embodied, the width of sub-segment 54*d* equals the total of the widths of sub-segments 54*b* and 54*c*. It will thus be understood that, as a result, each finger 55 and 56 will be equally spring biased so that as a mounting screw is inserted between the fingers, the screw will be subjected to equal, but oppositely directed, spring forces by fingers 55 and 56.

Also advantageously, the ends of both fingers 55 and 56 are bent forward by about 90° to form a pair of prongs (55A and 56A, respectively) which project outwardly from head portion 50. The prongs are positioned to project through aperture 15A when the grounding element is located in place, and, advantageously, the distance between the two prongs should be at least slightly less than the diameter of the device mounting screw so that it will be firmly grasped by the prongs and provide good electrical contact therebetween. Also, as preferably embodied, the prongs 55A and 56A are, themselves, bent back towards the rim of aperture 15A to help secure, or pre-load, the grounding element onto the cover member 14, as indicated in phantom in FIG. 9.

According to the invention, electrical connection between the grounding prong of a typical 3-conductor grounded plug (not shown) and receptacle 10 is established through integrally formed ground contact portions 59 and 60. As here embodied, ground contact portions 59 and 60 are substantially identical in that they are formed as a result of a generally I-shaped aperture stamped into the grounding element 34, resulting in a pair of flanges (71, 72) which depend from the remaining side edges (63, 64, respectively) of the grounding element, and are bent angularly inwardly so as to project downwardly toward each other, and into the interior of body 12 when installed in the device, as will be evident from the description below. The bent fingers thus provide an inwardly tapering opening (indicated at 73) for receiving and contacting the grounding prong of an electrical plug when the plug is inserted into the assembled receptacle. The side edges 63, 64 may also be bent so as to be generally co-planar with flanges 71 and 72, thereby providing an enlarged funnel-like opening for the ground prong.

Grounding element 34 is also advantageously provided with a pair of fingers (77, 78) which project laterally outward from the grounding element for locating element 34 in its desired position for the final assembly operation. As here embodied, fingers 77, 78 are formed by notches 77A and 78A cut into broadened stem portion 79. The fingers are proportioned to be wedged against projections 101 and 102 (described below) formed on the cover member 14 to help secure the grounding element 34 to the cover member along with the oppositely bent segments on prongs 55A and 56A, which secure terminal head portion 50 to the rim of aperture 15A. In this way, the grounding element is pre-loaded to the cover member prior to assembly and will be seated in proper position when the cover is placed over the receptacle body to facilitate automated assembly of the receptacle device.

Broadened stem portion 79 is also advantageously provided with an aperture 80 proportioned to threadably receive a wall plate mounting screw in order to ground the wallplate screw. The diameter of aperture 80 is preferably about equal to the interior thread diameter of the wall plate screw, and it includes a series of notches 80A (here, there are four such)notches) formed symmetrically around aperture 80 to provide deformable thread-engaging fingers (not numbered). In use, as the wallplate mounting screw is threaded into aperture 80, these thread-engaging fingers will be deformed to conform to the helical pattern of the screw threads and provide reliable grounding of the wall plate mounting screw to the device.

To facilitate threaded engagement between the wall plate screw and aperture 80, body 12 is provided with hollow annular pillar 90 which is aligned with aperture 80 when the device is fully assembled. The upper edge of pillar 90 supports ground element 34 in the vicinity surrounding aperture 80 during insertion of the wall plate screw. In addition, the hollow pillar is preferably proportioned to threadably receive the shank of the wallplate mounting screw (which is initially inserted through hole 41 in cover 14) not only to protect it from inadvertent contact with or arc-over from the energized contact/terminals 22 but also to hold the wallplate in place.

Grounding element 34 may also be formed to automatically ground the wallplate mounting screw when used in a decorator style receptacle device. As shown in phantom in FIG. 8, head portion 50 may be formed with extended head portion 50A which includes a U-shaped slot 58A. When the decorator style device is assembled, slot 58A is positioned behind one of the wallplate mounting screw openings (similar to opening 41 formed on receptacle cover 14) formed at either end of the the decorator receptacle face. The width of slot 58A is preferably slightly less than the outer thread diameter of the mounting screw. Thus, in view of the foregoing descriptions, it will be understood that as the screw is threaded in slot 58A, it will threadably engage opposite sides of the slot, thereby causing them to be distorted by the helical screw threads and assure good electrical contact between extended head portion 50A and the decorator-style wallplate mounting screw.

In use, the fully assembled receptacle 10 (assembly of the device in accordance with the invention will be described below) is mounted to an electrical outlet box generally in the usual way by inserting the device mounting screws (one is indicated at 7 in FIG. 4) through apertures 15A and 16A formed in mounting strap elements 15 and 16, respectively. The screw inserted through aperture 15A is securely grasped between the pair of flared prongs 55A and 56A of grounding element 34, forcing the prongs to flex outwardly towards the upper and lower edges of aperture 15A (which can act as a limit for the outward flexure of the prongs) As a result, good electrical contact is maintained between the mounting screw and the prongs 55A and 56A, and, therefore, with the entire grounding element 34.

In accordance with a principal advantage of the invention, when the receptacle is mounted to a metallic electrical outlet box that is already grounded, the receptacle device itself will automatically be grounded by virtue of the continuous electrically conductive path established from the outlet box through the mounting screw, through prongs 55A and 56A to grounding element 34 and thence to the two ground contact elements 59, 60. Thus, when the ground prong of a plug is inserted through an aperture 21 in an outlet face member 18, the prong is engaged by, and forms electrical contact with, one of the pairs of spring-action flanges (71, 72) of the ground element, thereby grounding the electrical connection between the receptacle and the plug. To support ground contact elements 59, 60 during inward insertion of the plug, body 12 includes a hollow pier (each indicated at 82) located under each ground contacts 59, 60. It will also be understood that piers 82 receive the ground prong of the plug to prevent inadvertent contact with, or arc-over from, any energized contact/terminals 22 in the device.

As preferably embodied, device 10 is also provided with means for grounding the receptacle by direct termination to the ground conductor of an electrical power cable for installations wherein the outlet box is not grounded. As here embodied, a portion of the end wall and the side wall at one corner of the receptacle body 12 is eliminated (as indicated at **12*c*), except for a short lip 12*d* adjacent the bottom of body 12, and replaced by an L-shaped ground terminal 26 which also includes ground termination screw 32 threadably engaged with terminal 26 for direct termination to a ground conductor when needed. L-shaped ground terminal 26 is advantageously retained in place inside lip 12*d*, both prior to and during the assembly operation by a slot (indicated at 12*e*) formed along the body sidewall and a similar slot 12*f* formed between the body end wall and the adjacent hollow pier 82. Terminal 26 may also be maintained in proper alignment by a tab 12*g* formed on the end wall which is adapted to engage notch 26A formed in terminal 26. (Advantageously and as preferably embodied, the body end wall may extend substantially completely to the corner, as indicated in phantom in FIG. 4**, for added wall strength and to maximize the amount of material available for the preferred sonic welding assembly described hereinafter.)

Terminal 26 preferably includes a pair of ground engaging studs (27, 28) which are positioned to correspond in position with a pair of canted fingers (74, 75) formed on ground element 34 to provide electrical connection between those two elements. Fingers 74 and 75 are canted (or formed at an angle) so as to flex when engaged by the studs 27 and 28 on terminal 26, yet remain biased somewhat against them, when installed in place to ensure good electrical mating between studs 27, 28 and fingers 74, 75.

Thus, in the event the outlet box has not been grounded so as to take advantage of the automatic grounding provided by the present invention, the receptacle can still be grounded by terminating the ground (green) conductor of an electrical power cable to the ground terminal screw 32 in substantially the same way as has been done heretofore. It will be understood that by virtue of the good electrical contact provided between studs 27, 28 on ground terminal 26 and the canted fingers 74, 75 formed on ground element 34, an alternate continuous ground path is provided via terminal screw 32, through ground terminal 26 and grounding element 34. Thus, when the ground conductor is terminated to screw 32, the receptacle outlets are grounded through the same grounding element 34 that provides the automatic grounding capability.

Figure 6:
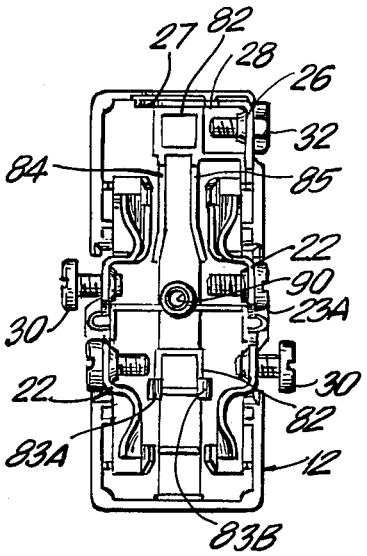
FIG. 6 is a plan view of the interior of the body portion of the electrical outlet receptacle shown in FIG. 1, with the internal electrical contact/terminals in place.

Referring now to FIG. 6, the interior configuration of body 12 is shown, with the internal terminal/contact members 22 installed therein. As previously indicated, a pair of raised hollow piers 82 extend upwardly from the bottom of body 12 to support ground contact portions 59, 60 against the force of insertion of a plug. To avoid arc-over from the most proximate part of energized contact/terminals 22, ramps 83A and 83B extend upward from the top of the middle pier 82. In addition, wall members 84 and 85 extend upwardly from the base of body 12 to help locate the ground member 34 and to prevent arc-over from the adjacent contacts 22. Also, as is evident from FIG. 4, the receptacle body and/or cover may be formed with very slight notches (not numbered) for accommodating grounding element 34 where it extends through the device housing when fully assembled.

Referring now more particularly to FIGS. 5 and 7, there is shown a preferred embodiment of the internal (surface of cover member 14 according to the present invention (FIG. 5), and the pre-loading of grounding element 34 to cover member 14 prior to final assembly of the device (FIG. 7). As preferably embodied, cover member 14 is provided with a pair of L-shaped studs 101 and 102 which are adapted to partially surround, and provide a friction fit with flanges 77 and 78 on grounding member 34 to secure grounding element 34 to the cover for the assembly operation. The distance between the opposed short legs of studs 101 and 102 is slightly less than the distance between the free end edges of fingers 77 and 78. Thus, as grounding element 34 is pre-loaded onto cover member 14, fingers 77 and 78 tend to be bent upwardly by engagement with the studs 101 and 102 to become wedged against the studs and secure member 34 in place. In addition, the long legs of studs 101 and 102 are received in slots 77A and 77B to help align the grounding element properly relative to the cover member during the pre-loading step.

As preferably embodied, the back of mounting strap portion 15 is provided with slightly indented area 109 around aperture 15B for receiving head portion 50. Additional structures may be formed on cover member 14 to assure proper alignment of parts. For example, pins 103 and 104 may be formed on cover member 14 to provide a slot-like recess for proper alignment of studs 27 and 28 on ground member 26 with canted fingers 74 and 75 on grounding element 34 to assure good electrical mating of these elements. For the same reason, block-like pin 105 may be formed on cover 14 to support connecting portion 54 and thereby brace the canted fingers 74 and 75 when engaged by studs 27 and 28 of ground member 26.

Assembly of the receptacle device according to the invention, is relatively simple to carry out. The receptacle body is placed on its bottom wall and the electrical contacts/terminals 22 are simply seated in their appropriate slots in body 12 and ground terminal 26 is inserted into position to complete corner 12C of the body. The grounding member 34 is press fit against cover by wedging flanges 77, 78 against L-shaped studs 101, 102 and by bending prongs 55A and 56A over the rim of aperture 15A to pre-load member 34 onto cover 14, as described above. The cover, with grounding member 34 attached thereto, is placed over body member 12, and the cover and body are forced against each other and subjected to sonic welding, thereby causing the cover and body to become joined together and form a welded seam along their abutting side and end wall edges. (Meanwhile, studs 27 and 28 of ground member 26 are pushed up against the canted fingers 71 and 72 to form good electrical mating between the two grounding parts.) It will be understood that by using sonic welding techniques, the strength of the bond between the body and cover is at least as strong as the actual wall segments which are welded together, thereby obviating any of the potential dangers of loosening of electrical connections within the device which otherwise can result from a weakened rivet or screw-type fastener.

It will be readily appreciated that the invention in its broader aspects is not limited to the specific embodiment herein shown and described. Rather, variations may be made therefrom within the scope of the accompanying claims without departing from the principles of the invention and without sacrificing its chief advantages.

What is claimed is:

1. An electrical wiring device adapted to be mounted adjacent a wall member having a hole therein permits the device to be secured to an electrical outlet box mounted behind the wall member, said electrical wiring device comprising:

a device body member adapted to receive and retain electrical terminal assemblies which are adapted to be terminated to the conductors of an electrical power cable;

a cover member proportioned to be affixed to said body member to form a device housing substantially enclosing the electrical terminal assemblies, said cover member having a pair of mounting strap elements formed integrally therewith and projecting from opposite ends thereof, said mounting strap element elongated to the maximum possible length to fit under a wallplate intended for use with the device, such that when said device is mounted adjacent the wall opening, the probability that the mounting strap elements will abut the wall member is maximized so as to substantially reduce the chance of having a "floating" installation.

2. An electrical outlet receptacle device adapted to be mounted adjacent a wall member having a hole therein which permits the device to the secured to an electrical outlet box mounted behind the wall member, the electrical outlet receptacle device comprising:

a receptacle body member adapted to receive and retain electrical terminal/contact assemblies which are adapted to be terminated to the conductors of an electrical power cable and to electrically mate with the blades of an electrical connecting plug;

a cover member adapted to be affixed to said body member, said cover member having apertures formed therein for permitting insertion of the plug blades for mating with said terminal/contact assemblies and said cover member having a pair of mounting strap elements formed integrally therewith and projecting from opposite ends of said cover member, said mounting strap elements terminating in free end edges which are beveled along their front facing surfaces, said mounting strap elements being elongated to the maximum possible length to fit under a wallplate intended for use with the device, such that when said receptacle is mounted adjacent the wall opening, the probability that the mounting strap elements will abut the wall member is maximized so as to substantially reduce the chance of having a "floating" installation.

3. An electrical outlet receptacle device adapted to be mounted adjacent a wall member having a hole therein which permits the device to be secured to an electrical outlet box mounted behind the wall member, the electrical outlet receptacle device comprising:

a receptacle body member adapted to receive and retain electrical terminal/contact assemblies to be terminated to the conductors of an electrical power cable and to electrically mate with the blades of an electrical connecting plug;

a cover member adapted to be affixed to said body member, said cover member having apertures formed therein for permitting insertion of the plug blades for mating with said terminal/contact assemblies and said cover member having a pair of mounting strap elements formed integrally therewith and projecting from opposite ends of said cover member, said mounting strap elements elongated to the maximum possible length to fit under a wallplate intended for use with the device, such that when said receptacle is mounted adjacent the wall opening, the probability that the mounting strap elements will abut the wall member is maximized so as to substantially reduce the chance of having a "floating" installation;

a unitary grounding element in the form of a somewhat elongate strip of copper alloy positioned within said receptacle housing, said grounding element providing two pairs of electrical grounding contacts formed integrally therewith and positioned adjacent each ground prong opening formed in the receptacle cover member for receiving a ground prong of a plug, said grounding element further with a head portion at one end having a generally H-shaped opening formed therein providing a pair of spring-like finger members which are spring biased so as to move away from each other with a generally equal but oppositely directed spring biasing force, said finger member projecting toward each other and being bent outwardly so as to protrude substantially through a mounting screw aperture formed on one of the mounting strap elements to receive and grasp a mounting screw inserted through said mounting screw aperture to provide electrical contact therebetween, such that when said receptacle device is mounted to a pre-grounded electrical outlet box, a continuous electrically conductive ground path is provided from the grounded outlet box, through the mounting screw, thence through the grounding element to each said pair of electrical grounding contacts for automatically grounding the ground prong of an electrical plug inserted into the receptacle device; and an additional ground member within said receptacle device in electrical contact with said grounding element, said additional ground member including a ground terminal screw accessible from the exterior of the receptacle housing for permitting direct termination of a ground conductor of an electrical power cable to the receptacle device to provide an alternate means for grounding the device when automatic grounding of said device is not carried out through the device mounting screw.

4. An electrical outlet receptacle device according to claim 3 wherein said ground element includes a pair of relatively deformable finger members projecting in generally opposite directions from each other, and wherein said cover member includes a pair of projecting stud members which are spaced apart by a distance slightly less than the distance between the free end edges of said deformable finger members such that said grounding element can be pre-loaded onto said cover member by pushing said grounding member against said cover member and forcing said deformable finger members between said projecting studs to cause said finger members to deform slightly and become wedged against said stud members, thereby securing said grounding element to said cover member.

5. An electrical outlet receptacle device according to claim 4, wherein said grounding element includes a pair of slots and wherein said cover member includes stud means proportioned to fit within said slots for aligning said grounding element on said cover member while it is being pre-loaded onto said cover member.

6. An electrical outlet receptacle device according to claim 5 wherein said deformable finger members and said slots are formed adjacent each other on said grounding element and wherein said projecting studs are formed adjacent each other to form a pair of generally L-shaped stud assemblies, each L-shaped stud assembly having one leg adapted to fit within one of said slots and its other leg being adapted to be wedged against the free end of one of said deformable finger members.

7. An electrical outlet receptacle device according to claim 18 wherein said prongs of said mounting screw engaging fingers are bent away from each other around the rim of said one aperture to help attach said grounding element to said cover member.

8. An electrical outlet receptacle device adapted to be mounted adjacent a wall member having a hole therein which permits the device to be secured to an electrical outlet box mounted behind the wall member, the electrical outlet receptacle device comprising:

a receptacle body member adapted to receive and retain electrical terminal/contact assemblies to be terminated to the conductors of an electrical power cable and to electrically mate with the blades of an electrical connecting plug;

a cover member adapted to be affixed to said body member, said cover member having apertures formed therein for permitting insertion of the plug blades for mating with said terminal/contact assemblies and said cover member having a pair of mounting strap elements formed integrally therewith and projecting from opposite ends of said cover member, said mounting strap elements elongated to the maximum possible length to fit under a wallplate intended for use with the device, such that when said receptacle is mounted adjacent the wall opening, the probability that the mounting strap elements will abut the wall member is maximized so as to substantially reduced the chance of having a "floating" installation;

a unitary grounding element in the form of a somewhat elongate strip of copper alloy positioned within said receptacle housing, said grounding element providing two pairs of electrical grounding contacts formed integrally therewith and positioned adjacent each ground prong opening formed in the receptacle cover member for receiving a ground prong of a plug, said grounding element further formed with a pair of spring-like finger members at one end, said finger members being positioned and proportioned to extend through a mounting screw aperture formed on one of the mounting strap elements to receive and grasp a mounting screw inserted through said mounting screw aperture to provide electrical contact therebetween, such that when said receptacle device is mounted to a pre-grounded electrical outlet box, a continuous electrically conductive ground path is provided from the grounded outlet box, through the mounting screw, thence through the grounding element to each said pair of electrical grounding contacts for automatically grounding the ground prong of an electrical plug inserted into the receptacle device; and an additional ground member within said receptacle device in electrical contact with said grounding element, said additional ground member including a ground terminal screw accessible from the exterior of the receptacle housing for permitting direct termination of a ground conductor of an electrical power cable to the receptacle device to provide an alternate means for grounding the device when automatic grounding of said device is not carried out through the device mounting screw.

9. An electrical outlet receptacle device adapted to be mounted adjacent a wall member having a hole therein which permits the device to be secured to an electrical outlet box mounted behind the wall member, the electrical outlet receptacle device comprising:

a receptacle body member adapted to receive and retain electrical terminal/contact assemblies to be terminated to the conductors of an electrical power cable and to electrically mate with the blades of an electrical connecting plug;

a cover member adapted to be affixed to said body member, said cover member having apertures formed therein for permitting insertion of the plug blades for mating with said terminal/contact assemblies and said cover having a pair of mounting strap elements formed integrally therewith and projecting from opposite ends of said cover member, said mounting strap elements elongated to the maximum possible length to fit under a wallplate intended for use with the device, such that when said receptacle is mounted adjacent the wall opening, the probability that the mounting strap elements will abut the wall member is maximized so as to substantially reduce the chance of having a "floating" installation;

a unitary grounding element in the form of a somewhat elongate strip of copper alloy positioned within said receptacle housing, said grounding element providing two pairs of electrical grounding contacts formed integrally therewith and positioned adjacent each ground prong opening formed in the receptacle cover member for receiving a ground prong of a plug, said grounding element further formed with a head portion at one end having a generally H-shaped opening formed therein providing a pair of spring-like finger members projecting toward each other and being bent outwardly so as to protrude substantially through a mounting screw aperture formed on one of the mounting strap elements to receive and grasp a mounting screw inserted through said mounting screw aperture to provide electrical contact therebetween, such that when said receptacle device is mounted to a pre-grounded electrical outlet box, a continuous electrically conductive ground path is provided from the grounded outlet box, through the mounting screw, thence through the grounding element to each said pair of electrical grounding contacts for automatically grounding the ground prong of an electrical plug inserted into the receptacle device, said grounding element including a further head portion projecting from said head portion, said further head portion having a generally U-shaped slot proportioned to receive a mounting screw for a decorator style wallplate member; and an additional ground member within said receptacle device in electrical contact with said grounding element, said additional ground member including a ground terminal screw accessible from the exterior of the receptacle housing for permitting direct termination of a ground conductor of an electrical power cable to the receptacle device to provide an alternate means for grounding the device when automatic grounding of said device is not carried out through the device mounting screw.

10. An electrical outlet receptacle device adapted to be mounted to an electrical outlet box through an opening in a wall member, the electrical outlet receptacle device comprising:

a receptacle body member adapted to receive and retain electrical terminal/contact assemblies to be terminated to the conductors of an electrical power cable and to electrically mate with the blades of an electrical connecting plug;

a cover member attached to said body member to form a substantially enclosed receptacle housing, said cover member including apertures formed therein to permit insertion of the plug blades for mating with said terminal/contact assemblies, said receptacle housing including mounting strap elements extending from each end thereof for mounting the receptacle to an outlet box;

a unitary grounding element in the form of a somewhat elongate strip of copper alloy positioned within said receptacle housing, said grounding element providing two pairs of electrical grounding contacts formed integrally therewith and positioned adjacent each ground prong opening formed in the receptacle cover member for receiving a ground prong of a plug, said grounding element providing electrical communication between each said pair of electrical grounding contacts and a mounting screw aperture formed on one of the mounting strap elements, said grounding element further formed with a head portion at one end having a generally H-shaped opening formed therein to provide a pair of spring-like finger members which project toward each other to protrude into a mounting screw aperture formed on one of the mounting strap elements, said spring fingers being bent outwardly so as to protrude substantially through said mounting screw aperture and proportioned to receive and grasp a mounting screw inserted through said mounting screw aperture to provide electrical contact therebetween, such that when said receptacle device is mounted to a pre-grounded electrical outlet box, a continuous electrically conductive ground path is provided from the grounded outlet box, through the mounting screw, thence through the grounding element to each said pair of electrical grounding contacts for automatically the ground prong of an electrical plug inserted into the receptacle device; and an additional ground member within said receptacle device in electrical contact with said grounding element, said additional ground member including a ground terminal screw accessible from the exterior of the receptacle housing for permitting direct termination of a ground conductor of an electrical power cable to the receptacle device to provide an alternate means for grounding the device when automatic grounding of said device is not carried out through the device mounting screw.

11. An electrical outlet receptacle device according to claim 10, wherein said grounding element includes an aperture formed therein for receiving a wallplate mounting screw for automatically grounding said wallplate mounting screw when threaded through said aperture.

12. An electrical outlet receptacle device according to claim 11, wherein said aperture includes at least one relatively deformable thread engaging finger adapted to be received within the helical threads within the wallplate mounting screw, each said finger being deformed to conform to the helical pattern of the screw threads when said wallplate mounting screw is threaded into said aperture in order to provide reliable electrical mounting between said grounding element and said wallplate mounting screw.

13. An electrical device according to claim 10, wherein said grounding element includes a further head portion projecting from said head portion, said further head portion having a generally U-shaped slot proportioned to threadably receive a mounting screw for a decorator style wallplate member.

14. An electrical outlet receptacle device according to claim 10 wherein said spring fingers are spring biased so as to move away from each other with a generally equal but oppositely directed spring biasing force.

15. An electrical outlet receptacle device according to claim 14 wherein said ground element includes a pair of relatively deformable finger members projecting in generally opposite directions from each other, and wherein said cover member includes a pair of projecting stud members which are spaced apart by a distance slightly less than the distance between the free end edges of said deformable finger members such that said grounding can be pre-loaded onto said cover member by pushing said grounding member against said cover member and forcing said deformable finger members between said projecting studs to cause said finger members to deform slightly and become wedged against said stud members, thereby securing said grounding element to said cover member.

16. An electrical outlet receptacle device according to claim 15, wherein said grounding element includes a pair of slots and wherein said cover member includes stud means proportioned to fit within said slots for aligning said grounding element on said cover member while it is being pre-loaded onto said cover member.

17. An electrical outlet receptacle device according to claim 16 wherein said deformable finger member and said slots are formed adjacent each other on said grounding element and wherein said projecting studs are formed adjacent each other to form a pair of generally L-shaped stud assemblies, each L-shaped stud assembly having one leg adapted to fit within one of said slots and its other leg being adapted to be wedged against the free end of one of said deformable finger member.

18. An electrical outlet receptacle device according to claim 17 wherein said prongs of said mounting screw engaging fingers are bent away from each other around the rim of said one aperture to help attach said grounding element to said cover member.

19. An electrical outlet receptacle device adapted to be mounted to an electrical outlet box through an opening in a wall member, the electrical outlet receptacle device comprising:

a receptacle body member adapted to receive and retain electrical terminal/contact assemblies to be terminated to the conductors of an electrical power cable and to electrically mate with the blades of an electrical connecting plug;

a cover member attached to said body member to form a substantially enclosed receptacle housing, said cover member including apertures formed therein to permit insertion of the plug blades for mating with said terminal/contact assemblies, said receptacle housing including mounting strap elements extending from each end thereof for mounting the receptacle to an outlet box;

a unitary grounding element in the form of a somewhat elongate strip of copper alloy positioned within said receptacle housing, said grounding element providing two pairs of electrical grounding contacts formed integrally therewith and positioned adjacent each ground prong opening formed in the receptacle cover member for receiving a ground prong of a plug, said grounding element further formed with a pair of spring-like finger members at one end, said finger members being positioned and proportioned to extend through the mounting screw aperture formed on one of the mounting strap element to receive and grasp a mounting screw inserted through said mounting screw aperture to provide electrical contact therebetween, such that when said receptacle device is mounted to a pre-grounded electrical outlet box, a continuous electrically conductive ground path is provided from the grounded outlet box, through the mounting screw, thence through the grounding element to each said pair of electrical grounding contacts for automatically grounding the ground prong of an electrical plug inserted into the receptacle device; and an additional ground member within said receptacle device in electrical contact with said grounding element, said additional ground member including a ground terminal screw accessible from the exterior of the receptacle housing for permitting direct termination of a ground conductor of an electrical power cable to the receptacle device to provide an alternate means for grounding the device when automatic grounding of said device is not carried out through the device mounting screw, said additional ground member including at least one integral stud projecting form one edge of said additional ground member, each said projecting stud being positioned to make electrical mating contact with a deformable finger on said grounding element, such that good electrical mating contact is provided between said grounding element and said additional ground member without the need for welding or other permanent attachment between said grounding element and said additional ground member.

20. A method for assembling an electrical outlet receptacle device having a cover member and a body member both made from an injection moldable thermoplastic material and forming a device housing when assembled together, said method comprising the steps of:

inserting electrical terminal/contact assemblies into the interior of the receptacle body portion when lying on its bottom wall;

pre-loading a grounding element to the cover member along the back facing surface thereof, with pairs of ground contacts positioned adjacent each ground prong opening formed in the cover member for receiving the ground prong of an electrical connecting plug and with a pair of screw engaging fingers protruding through a mounting screw aperture formed in one of the mounting strap elements on the receptacle device;

placing the cover member with the grounding element pre-loaded thereto over the open top of the receptacle body portion;

forcing said cover member and body member against each other to secure the contact members in place; and sonically welding the two members together to form a securely assembled receptacle housing.

21. A method according to claim 20, which further includes the step of providing an additional grounding member in said body member in such position that when said cover and body members are forced together during said sonic welding step, said additional grounding member and said grounding element are in electrical mating relation to provide alternate grounding means via a ground terminal screw on said additional grounding element for direct termination to a ground conductor in an electrical power cable.

22. A method according to claim 20 wherein said step of pre-loading said grounding element to said cover member includes the step of forcing a pair of oppositely projecting deformable fingers on said grounding element between a pair of projecting studs formed on said cover member, the spacing between said studs being slightly less than the distance between the free ends of said oppositely projecting deformable finger members, such that as said grounding element is forced against said cover member, said spring fingers deform slightly so as to become wedged against said projecting stud members on said cover member.

23. A method according to claim 22 wherein said pre-loaded step further includes the step of bending said screw engaging fingers about the rim of the mounting screw aperture formed on one of said mounting strap elements to help fasten said grounding element to said cover member.

24. An electrical wiring device adapted to be mounted adjacent a wall member having a hole therein which permits the device to be secured to an electrical outlet box mounted behind the wall member, said electrical wiring device comprising:

a device body member adapted to received and retain electrical terminal assemblies which are adapted to be terminated to the conductors of an electrical power cable;

a cover member proportioned to be affixed to said body member to form a device housing substantially enclosing the electrical terminal assemblies, said device housing having a pair of mounting strap elements formed integrally therewith and projecting from opposite ends thereof, said mounting strap elements terminating in free edges which are beveled along their front facing surfaces, said mounting strap elements elongated to the maximum possible length to fit under a wallplate intended for use with the device, such that when said device is mounted adjacent the wall opening, the probability that the mounting strap elements will abut the wall member is maximized so as to substantially reduce the chance of having a "floating" installation.

25. An electrical wiring device adapted to be mounting adjacent a wall member having a hole therein which permits the device to be secured to an electrical outlet box mounting behind the wall member, said electrical wiring device comprising:

a device body member adapted to receive an retain electrical terminal assemblies which are adapted to be terminated to the conductors of an electrical power cable;

a cover member proportioned to be affixed to said body member to form a device housing substantially enclosing the electrical terminal assemblies, said device housing a pair of mounting strap elements formed integrally therewith and projecting from opposite ends thereof, said mounting strap elements elongated to the maximum possible length to fit under a wallplate intended for use with the device, such that when said device is mounted adjacent the wall opening, the probability that the mounting strap elements will abu the wall member is maximized so as to substantially reduce the chance of having a "floating" installation, each said mounting strap element being general square along its side edges for maximizing the available surface area for abutting the wall member, thereby further reducing the chance of a "foating" installation.

26. A wiring device according to claim 25 wherein each said mounting strap element includes at least one diagonally extending notch formed therein to provide break off tabs which can be removed from said mounting strap elements to reduce the overall length of the mounting strap when the device is to be used with special configuration outlet boxes.

27. A wiring device according to claim 26 wherein said body and cover members are formed from an injection moldable thermo-plastic material.

28. A wiring device according to claim 27, wherein said body and cover members are secured together by sonic welding techniques.

* * * * *